US012778252B2

(12) United States Patent
Robinson

(10) Patent No.: US 12,778,252 B2
(45) Date of Patent: Nov. 3, 2026

(54) PROTECTIVE PORTABLE INFORMATION-BEARING CARD SLEEVE

(71) Applicant: Laniece Robinson, Detroit, MI (US)

(72) Inventor: Laniece Robinson, Detroit, MI (US)

( * ) Notice: Subject to any disclaimer, the term of this patent is extended or adjusted under 35 U.S.C. 154(b) by 0 days.

(21) Appl. No.: 18/909,939

(22) Filed: Oct. 8, 2024

(65) Prior Publication Data

US 2025/0031818 A1 Jan. 30, 2025

Related U.S. Application Data

(63) Continuation of application No. 17/573,601, filed on Jan. 11, 2022, now abandoned.

(51) Int. Cl.
*A45C 11/18* (2006.01)
*A45C 1/06* (2006.01)

(52) U.S. Cl.
CPC ..... *A45C 11/182* (2013.01); *A45C 2011/186* (2013.01)

(58) Field of Classification Search
CPC .. A45C 1/00; A45C 1/02; A45C 1/024; A45C 1/04; A45C 1/06; A45C 1/08; A45C 1/10; A45C 11/00; A45C 11/001; A45C 11/002; A45C 11/003; A45C 11/008; A45C 11/04; A45C 11/08; A45C 11/14; A45C 11/16; A45C 11/18; A45C 11/182; A45C 11/184; A45C 11/20; A45C 11/22; A45C 11/24; A45C 11/26; A45C 11/32;
(Continued)

(56) References Cited

U.S. PATENT DOCUMENTS 2,718,911 A * 9/1955 Solomon ..... A45C 1/06 150/147
3,537,728 A * 11/1970 Reese ..... B42F 19/00 281/31

(Continued)

FOREIGN PATENT DOCUMENTS

DE 102013010389 B4 * 12/2018 ..... G06K 19/07327
ES 2257915 A1 * 8/2006 ..... A45C 11/182

(Continued)

OTHER PUBLICATIONS

Guardian Gift Card Envelopes with Clear Window, Amazon. com, https://www.amazon.com/Guardian-Window-Gift-Envelopes-White/dp/B081VS24ST, Date First Available Nov. 22, 2019, Date Accessed Oct. 21, 2025.

*Primary Examiner* — Anthony D Stashick
*Assistant Examiner* — Marcos Javier Rodriguez Molina
(74) *Attorney, Agent, or Firm* — University of Detroit Mercy School of Law Intellectual Property Law Clinic

(57) ABSTRACT

A protective portable information-bearing card sleeve used to prevent fraud and credit card theft even while using the card. First and second planar walls disposed in spaced relationship to each other and each having a first edge connected to the first edge of the other wall; said walls being sized and connected so as to form a housing that removably retains the card; wherein the first wall includes a flexible upper portion that permits visible exposure of a first surface of the card by bending the flexible portion outwardly away from the second wall so as to expose the first surface of the card. The case consists essentially of polymer, plastic, and at least one metal, and wherein one of the walls have at least one rectangular cut out to permit visible exposure of a second surface of the card.

14 Claims, 4 Drawing Sheets

(58) Field of Classification Search

CPC ... A45C 11/321; A45C 11/323; A45C 11/324; A45C 11/325; A45C 11/326; A45C 11/327; A45C 11/328; A45C 11/34; A45C 11/36; A45C 11/38; A45C 13/00; A45C 13/001; A45C 13/002; A45C 13/005; A45C 13/007; A45C 13/008; A45C 13/02; A45C 13/023; A45C 13/03; A45C 13/04; A45C 13/06; A45C 13/08; A45C 13/083; A45C 13/10; A45C 13/103; A45C 13/1038; A45C 13/1046; A45C 13/1053; A45C 13/1069; A45C 13/1076; A45C 13/1084; A45C 13/1092; A45C 13/12; A45C 13/123; A45C 13/14; A45C 13/18; A45C 13/185; A45C 13/20; A45C 13/24; A45C 13/26; A45C 13/262; A45C 13/28; A45C 13/30; A45C 13/36; A45C 13/42; A45C 15/00; A45C 15/02; A45C 15/04; A45C 15/06; A45C 15/08; A45C 2001/006; A45C 2001/022; A45C 2001/026; A45C 2001/028; A45C 2001/062; A45C 2001/065; A45C 2001/067; A45C 2001/083; A45C 2001/086; A45C 2001/101; A45C 2001/104; A45C 2001/105; A45C 2001/107; A45C 2001/108; A45C 2003/005; A45C 2003/007; A45C 2003/008; A45C 2007/0004; A45C 2007/0013; A45C 2009/007; A45C 2011/007; A45C 11/186; A45C 2011/188; A45C 2011/322; A45C 2013/025; A45C 2013/026; A45C 2013/1015; A45C 2013/1061; A45C 2013/226; A45C 2013/303; A45C 2013/306; A45C 2200/00; A45C 2200/05; A45C 2200/10; A45C 2200/15; A45C 2200/20; A45C 3/00; A45C 3/001; A45C 3/02; A45C 3/04; A45C 3/045; A45C 3/06; A45C 3/08; A45C 3/10; A45C 5/00; A45C 5/005; A45C 5/02; A45C 5/03; A45C 5/06; A45C 5/14; A45C 7/0036; A45C 7/004; A45C 7/0045; A45C 7/0054; A45C 7/0059; A45C 7/0063; A45C 7/0077; A45C 7/0081; A45C 7/0086; A45C 7/009; A45C 7/0095; A45C 9/00; B65D 1/00; B65D 1/40; B65D 11/22; B65D 17/4012; B65D 19/00; B65D 21/02; B65D 21/086; B65D 2203/00; B65D 2203/02; B65D 2221/00; B65D 23/003; B65D 23/08; B65D 23/14; B65D 2313/02; B65D 2313/04; B65D 2401/00; B65D 25/00; B65D 25/04; B65D 25/06; B65D 25/10; B65D 25/103; B65D 25/20; B65D 25/205; B65D 25/22; B65D 2517/0014; B65D 2517/0022; B65D 2517/0041; B65D 2517/0052; B65D 2517/0098; B65D 2575/3236; B65D 2575/3245; B65D 2585/56; B65D 27/00; B65D 27/02; B65D 27/04; B65D 27/14; B65D 27/16; B65D 27/30; B65D 33/00; B65D 33/1658; B65D 33/1675; B65D 33/1691; B65D 33/20; B65D 33/22; B65D 33/2533; B65D 41/04; B65D 43/16; B65D 43/162; B65D 43/163; B65D 43/164; B65D 43/22; B65D 5/009; B65D 5/04; B65D 5/20; B65D 5/24; B65D 5/38; B65D 5/4204; B65D 5/4208; B65D 5/4233; B65D 5/48018; B65D 51/007; B65D 51/248; B65D 53/02; B65D 63/109; B65D 65/40; B65D 7/10; B65D 73/0007; B65D 73/0028; B65D 73/0035; B65D 73/0064; B65D 75/008; B65D 75/225; B65D 75/30; B65D 75/32; B65D 75/323; B65D 75/326; B65D 75/327; B65D 75/36; B65D 75/525; B65D 75/527; B65D 75/545; B65D 75/5805; B65D 75/5811; B65D 75/5816; B65D 75/5855; B65D 75/5866; B65D 75/5877; B65D 75/5894; B65D 77/006; B65D 77/042; B65D 77/245; B65D 77/28; B65D 81/022; B65D 81/24; B65D 81/263; B65D 81/28; B65D 81/3205; B65D 81/3266; B65D 81/36; B65D 81/3876; B65D 81/3879; B65D 81/3886; B65D 83/04; B65D 83/0463; B65D 83/08; B65D 83/0858; B65D 83/12; B65D 85/00; B65D 85/1045; B65D 85/18; B65D 85/42; B65D 85/72; B65D 85/8043; B65D 88/54; B65D 90/32

USPC ..... 40/124.01, 124.06, 124.08, 124.2, 27.5, 40/330, 341, 405, 406, 490, 513, 586, 40/642.02, 649, 653, 654, 654.01, 661, 40/661.06, 661.07, 664, 765, 775, 776, 40/777; 206/215, 216, 232, 234, 307, 206/307.1, 320, 37, 37.1, 37.4, 38, 38.1, 206/39, 39.1, 39.3, 39.4, 39.5, 39.6, 425, 206/449, 459.5, 472, 477, 555, 556, 565, 206/581, 804, 805, 815; 220/4.23, 523, 220/739, 835, 839; 229/67.3, 72, 75; 383/111

See application file for complete search history.

(56) References Cited

U.S. PATENT DOCUMENTS

| | | | | |
|---|---|---|---|---|
| 5,700,036 | A * | 12/1997 | Smith, III | A45C 11/182 283/901 |
| 6,149,003 | A | 11/2000 | Day | |
| D471,354 | S | 3/2003 | Daniels | |
| 7,385,508 | B1 | 6/2008 | Ray et al. | |
| D686,414 | S | 7/2013 | Schneider | |
| D691,195 | S * | 10/2013 | Klosky | B42F 21/02 D19/26 |
| 8,726,952 | B2 | 5/2014 | Jambunathan et al. | |
| 8,776,846 | B1 * | 7/2014 | Thompson | A45C 11/182 150/147 |
| D745,278 | S | 12/2015 | Gluck et al. | |
| D746,059 | S | 12/2015 | Gross et al. | |
| D760,496 | S | 7/2016 | Schioll | |
| D776,426 | S | 1/2017 | Smith | |
| D835,410 | S | 12/2018 | Chan et al. | |
| D842,605 | S | 3/2019 | Bo | |
| D866,176 | S | 11/2019 | Hoshikawa | |
| D866,962 | S | 11/2019 | Parsons | |
| D907,364 | S * | 1/2021 | Robinson | D3/300 |
| 2009/0065111 | A1 * | 3/2009 | Ohayon | G06Q 20/10 150/147 |
| 2010/0065171 | A1 | 3/2010 | Uzelac | |

(56) References Cited

U.S. PATENT DOCUMENTS

| | | | | |
|---|---|---|---|---|
| 2016/0113369 | A1* | 4/2016 | Husbands | A45C 11/182<br>150/147 |
| 2019/0387850 | A1* | 12/2019 | Bernard | A45C 1/06 |

FOREIGN PATENT DOCUMENTS

| | | | | |
|---|---|---|---|---|
| ES | 2257915 | B1 | 7/2007 | |
| FR | 2716093 | A1 * | 8/1995 | A45C 11/182 |
| FR | 2738940 | A1 * | 3/1997 | G09C 1/02 |
| FR | 2770102 | A1 * | 4/1999 | A45C 11/182 |
| FR | 3031244 | A1 * | 7/2016 | H01Q 1/526 |
| WO | WO-2011065575 | A1 * | 6/2011 | G07D 7/16 |

* cited by examiner

PROTECTIVE PORTABLE INFORMATION-BEARING CARD SLEEVE

BACKGROUND

The present disclosure relates to novel protective information-bearing card sleeve that can usably contain a single wallet-sized card or the like. More particularly, the present disclosure is directed to sleeve-type holding devices.

In a world where credit card fraud is widespread it is important for credit card users to remain protected at all times. When a card user pulls out their card for use they are exposed to potential fraud and theft from a variety of angles. People committing credit card fraud or theft can steal information from a card from a variety of methods such as utilizing cameras and/or even using devices to collect payment from an unaware cardholder while the card is still in their wallet or pocket.

While there are devices to protect a card while it is inside the device, as soon as a cardholder pulls it out of the device they are exposed. Unfortunately, there are no devices to protect a cardholder while the card is in use. Various devices have been proposed as protective sleeves that protect the card while stored. These devices do little to protect the card while in the card is interacting with a suitable payment device

SUMMARY

A sleeve configured to hold a portable information-bearing card is disclosed herein and is particularly useful for portable information-bearing cards of the type that include a magnetic strip, an RFID chip, and/or a data chip and that have standard credit card layout and dimensions including a length, height, and thickness. The sleeve comprises first and second planar walls each having an upper wall region and a lower wall region, the first and second planar walls being disposed in spaced parallel relationship to each other, wherein each planar wall has a peripheral edge defined by first and second side edges, an upper edge, and a bottom edge. The card has the following features:

- the planar walls are visibly and transmissively opaque, whereby in use with the card in the sleeve, the planar walls can prevent visible or transmissive access to the data stored on the card;
- each edge of the peripheral edges of the planar walls is rectilinear;
- each bottom edge is located at a lower end of each lower wall region;
- each upper edge is located at an upper end of each upper wall region;
- each side edge of each planar wall extends alongside both the upper and lower wall regions of that planar wall between the upper and lower edges of that planar wall;
- the bottom edge of each planar wall is connected to the bottom edge of the other planar wall, thereby forming a bottom wall;
- the lower wall region of each planar wall is connected to the lower wall region of the other planar wall along the first side edges of the planar walls, thereby forming a side wall; and
- the planar walls being sized relative to the dimensions of the card, such that the planar walls, bottom wall, and side wall together form a housing that can removably retain the card inside the housing and that is accessible for insertion or removal of the card from either an upper edge opening or a second side edge opening.

In the sleeve, each upper wall region is separated from the lower wall region by at least one detent extending at least partially between the first and second edges in a direction parallel to the bottom wall, whereby that upper wall region can flexibly bend out of plane with the lower wall region; and the at least one detent is located at a height from the bottom wall that is less than a height of the magnetic strip from the bottom of the card, whereby in use with the card in the sleeve in contact with the bottom wall, the magnetic strip can be covered by one of the upper wall regions when that upper wall region is not deflected out of plane with the lower wall region, and can be uncovered for swiping in a card reader by bending the upper wall away from the card to thereby enable use of the magnetic strip for a transaction without removing the card from the sleeve; and Furthermore, the second side edge of each planar wall is adjacent to the second side edge of the other planar wall without being connected to each other so as to provide the side edge opening, whereby in use with the card in the sleeve, the card may be advanced partially out through the side edge opening to thereby enable use of the data chip for a transaction without removing the card from the sleeve.

In another aspect of the invention, there is provided a sleeve that includes a first planar wall member that has a central body region defining an outwardly oriented face and an inwardly oriented face opposed to the outwardly oriented face that is configured to releasably contact a portable information-bearing card contained therein. The sleeve also includes a second planar wall member that is connected to the first planar wall member and is disposed in disposed in spaced relationship with the first planar wall member. The second planar wall member also has a central body region defining an outwardly oriented face and an inwardly oriented face opposed to the outwardly oriented face that is configured to releasably contact a portable information-bearing card contained therein. The sleeve is configured to permit magnetic storage media such as a swipe strip to be accessed by the user during a transaction without removing the portable information-bearing card from the sleeve. The sleeve is also configured to permit access to a data chip contained on the portable information-bearing card to be accessed in a financial transaction without removing the portable information-bearing card from the associated sleeve in a manner that prevents unwanted or impermissible visual or electronic access to identifying indicia or information associated with the portable information-bearing card.

BRIEF DESCRIPTION OF THE DRAWINGS

The various features, advantages and other uses of the present apparatus will become more apparent by referring to the following detailed description and drawing in which.

DETAILED DESCRIPTION

Disclosed herein is a device for holding a portable information-bearing card in a manner that reduces or eliminates opportunities for third parties such as criminal and hackers to obtain the card-holder's account information both while the card is present in the card-holder's wallet, pocket, or the like as well as during transactions using the portable information-bearing card. In certain aspects, the present disclosure is directed to an effective mechanical approach for enhancing portable information-bearing card security and privacy during use and storage. A new and convenient way is thus provided for users of information-bearing cards to effectively deal with the hazards of "skimming" or the theft of private information thereby minimizing incidents of identity theft and/or unauthorized use of the portable information-bearing card or cards and associated accounts.

The device as disclosed can be used with various types of portable information-bearing cards. Non-limiting examples of suitable portable information-bearing cards can be portable information-bearing cards used in financial transactions such as credit cards, debit cards, various ATM cards, prepaid cards such as gift cards and the like. It is also considered to be within the purview of this disclosure that the portable information-bearing card can be a card that may contain other important personal information such as medical information, employee access information or the like. Non-limiting examples of such cards include medical ID and/or insurance cards, driver's licenses, employee ID cards, door lock swipe cards, and the like.

Figure 6:
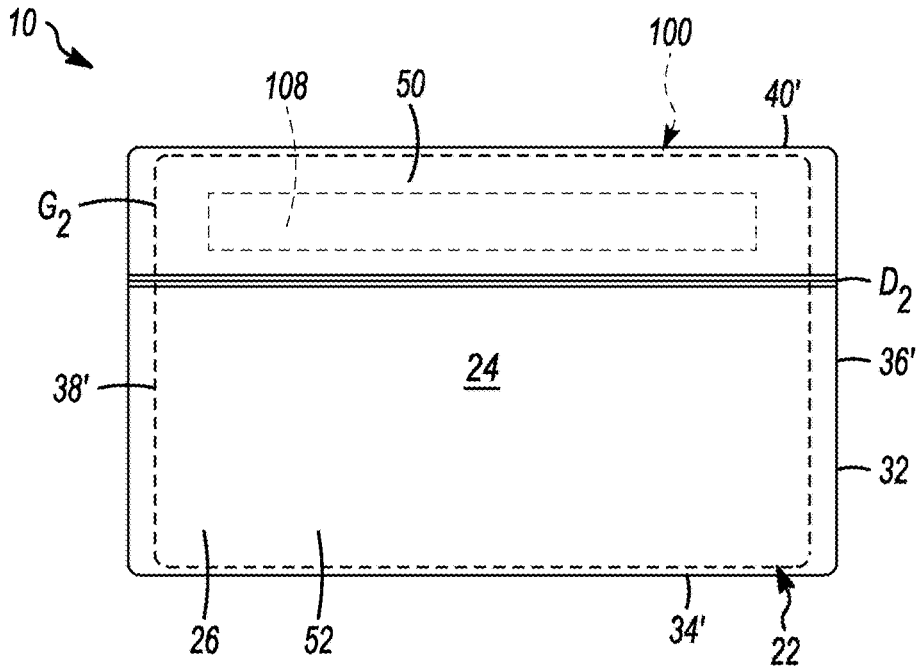
FIG. 6 is a rear elevational view of the protective information-bearing card sleeve of FIG. 1 with an embodiment of a portable information-bearing card depicted in phantom.
Figure 7:
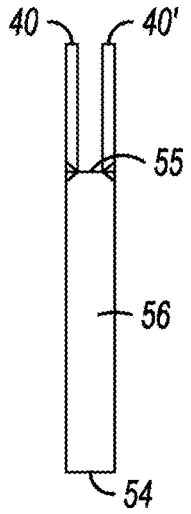
FIG. 7 is a right side view of the protective information-bearing card sleeve of FIG. 1.
Figure 8:
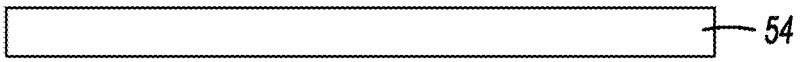
FIG. 8 is a bottom view of the protective information-bearing card sleeve of FIG. 1.
Figure 9:
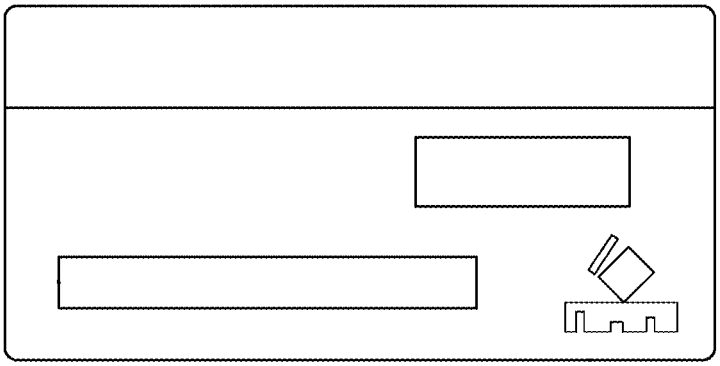
FIG. 9 is a front perspective view of an alternate embodiment of the protective information-bearing card sleeve as disclosed herein.
Figure 10:
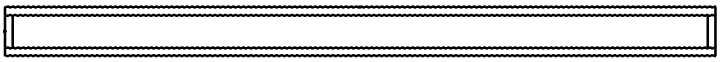
FIG. 10 is a top elevational view of the protective information-bearing card sleeve of FIG. 9.
Figure 11:
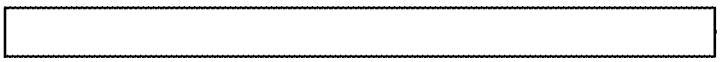
FIG. 11 is a bottom elevational view of the protective information-bearing card sleeve of FIG. 9.
Figure 12:
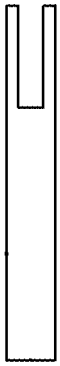
FIG. 12 is a right side elevational view of the protective information-bearing card sleeve of FIG. 9.

Suitable portable information-bearing cards can be lightweight rigid durable members composed of materials such as plastic. Portable information-bearing cards can have any suitable dimensions and the portable information-bearing card sleeve as disclosed herein can be suitably dimensioned to receive the associated portable information-bearing card therein. In certain embodiments, the portable information-bearing card can be dimensioned to be accommodated in a conventional wallet type device. However, it is within the purview of this disclosure to configure the portable protective information-bearing card sleeve to accommodate associated portable information-bearing cards of other dimensions. In the embodiment depicted in the various drawing figures, the portable information-bearing card 100 is an elongated rectilinear member having a first planar face 102 and a second planar face 104 that is opposed to the first planar face 102. In the embodiment depicted, the portable information-bearing card 100 has a length $L_C$ and a height $H_C$ with the value of height $H_C$ being less than the value of length $L_C$ in certain embodiments The portable information-bearing card 100 that is housed in the protective portable information-bearing card sleeve 10 as disclosed herein may include one or more suitable data storage media members. Non-limiting examples of such as RFID chips 106, other data microchips, magnetic storage media 108 (see FIG. 6), and the like. The portable information-bearing card 100 may also include visual indicia and information that includes, but is not limited to account numbers 110, the name of the cardholder 112, the name of the issuing institution or enterprise 114, and the like. The data storage media and/or visual indica can be present on one or both faces of the surface of the information-bearing card 100. In certain configurations, the portable information-bearing card 100 can be configured with at least one elongated strip of magnetic data storage media (swipe strip) 108 and/or at least one data storage chip 106. In certain configurations, the portable information-bearing card 100 can include at least one swipe strip 108 on one planar face 104 and at least one data storage chip 106 on the other face 102.

In certain embodiments, such as the embodiment illustrated in FIGS. 1-8, the device as disclosed herein can be configured as a sleeve 10 and can include a first planar wall member 12 that has a central body region 14 defining an outwardly oriented face 16 and an inwardly oriented face 18 opposed to the outwardly oriented face 16 that is configured to releasably contact a portable information-bearing card contained therein, such as portable information-bearing card 100. The sleeve 10 also includes a second planar wall member 22 that is connected to the first planar wall member 12 and is disposed in spaced relationship with the first planar wall member 12. The second planar wall member 22 also has a central body region 24 defining an outwardly oriented face 26 and an inwardly oriented face 28 opposed to the outwardly oriented face 26 that is configured to releasably contact a portable information-bearing card 100 contained therein.

The first and second planar members 12, 22 each have an associated central body region defining an outwardly oriented face and an inwardly oriented face and an associated peripheral edge 30, 32. Where desired or required, the first and second planar members 12, 22 can each have an outer peripheral edge 30, 32 that has a generally rectilinear configuration and can provide the sleeve 10 with a generally rectilinear configuration when viewed in side view. As used herein, the term "rectilinear configuration" is taken to mean a geometric shape that includes four sided polygons such as rectangles and squares. The outer peripheral edge 30, 32 can include four individual legs which are each joined to the others in an essentially 90 0 angle. The junction between various legs of the peripheral side edges can be sharp or rounded as desired or required. In configurations such as the those depicted in the various drawing figures, the individual legs can form a lower edge 34, 34' opposed side edges 36, 36', 38, 38' and an upper edge 40, 40' opposed to the lower edge 34, 34'.

In certain embodiments, the first planar member 12 can include the central body member 16 and the second planar member 22 can include central body member 18. The central body member 16 of the first planar member 12 can have an upper first planar wall region 46 and a lower first planar wall region 48. The central body member 16 of the second planar member 22 can have an upper second planar wall region 50 and a lower second planar wall region 52. In certain embodiments, the lower first panel wall region 48 and the lower second panel region 52 can be in fixed parallel relationship to one another and define an inner slot into which the desired portable information-bearing card 100 can be inserted.

When the portable information-bearing card 100 is inserted, it is contemplated that the first planar member 12 and the second planar member 22 will be in outer overlying relationship with the respective faces of the portable information-bearing card 100. Where desired or required, at least a portion of the inwardly oriented face 18 of the first planar member 12 and/or at least a portion of the inwardly oriented face 28 of the second planar member 22 can be in releasable contact with the portable information-bearing card 100. In certain embodiments, the contact region will be located, at least in part, in the respective lower first planar wall region 48 and/or in the lower second planar wall region 52.

The first planar region 12 and the second planar region 22 are connected to one another by a suitable connection means located proximate to the lower edge 34, 34'. In certain embodiments, it is contemplated that the respective lower edges 34, 34' can be attached directedly to each other by any suitable mechanism. Non-limiting examples of attachment mechanisms include adhesive bonding, integral molding and the like. It is also within the purview of this disclosure that the attachment mechanism can include, in whole or in part, mechanical attachment such as seaming clamping and the like.

While it is within the purview of this disclosure that the first planar region 12 and the second planar region 22 can be attached directly to one another, in certain embodiments, the sleeve 10 can include a bottom edge wall member 54. The bottom edge wall member 54 can be a planar member that extends between at least a portion of lower edge 34 defined on the first planar wall member 12 and at least a portion of the lower edge 34' defined the second planar wall member 22 and can be integrally connected thereto. The bottom lower edge wall member 54 can be continuous or intermittent and will have suitable dimensions and configuration to maintain the portable information-bearing card 100 in position in the sleeve 10. When the sleeve 10 includes a bottom edge wall member 54, it is contemplated that the bottom edge wall member 54 can has a width suitable to accommodate the thickness of the portable information-bearing card 100 to be housed therein.

The sleeve 10 can also include a side wall member 56 that can extend between the first side edge 36 of the first planar wall member 12 and the first side edge 36' of the second planar wall member 22. The side wall member 56 can have a width similar or equal to the width of the associated bottom edge wall member 54. The side wall member 56 can be continuous or intermittent. In certain embodiments, the side wall member 56 can be connected to the bottom edge wall member 54. In certain embodiments, the side wall member 56 and the bottom edge wall member 54 can be distinct from one another.

The side wall member 56 can have a length that is less than the value of the associated first side edges 36, 36'. The side wall member 56 can be positioned proximate to the lower edge 34 of the first planar member 12 and the second planar member 22. The side wall member 56 may have an upper edge 55 that is located at a position removed from upper edge 40, 40' of the respective first planar wall member 12 and the second planar wall member 22. In certain embodiments, the upper edge 55 of the side wall member 56 can terminate at a location that is proximate to the junction between the respective upper planar wall regions 46, 50 and the lower planar wall regions 48, 52 of the first and second panel members 12, 22.

Figure 1:
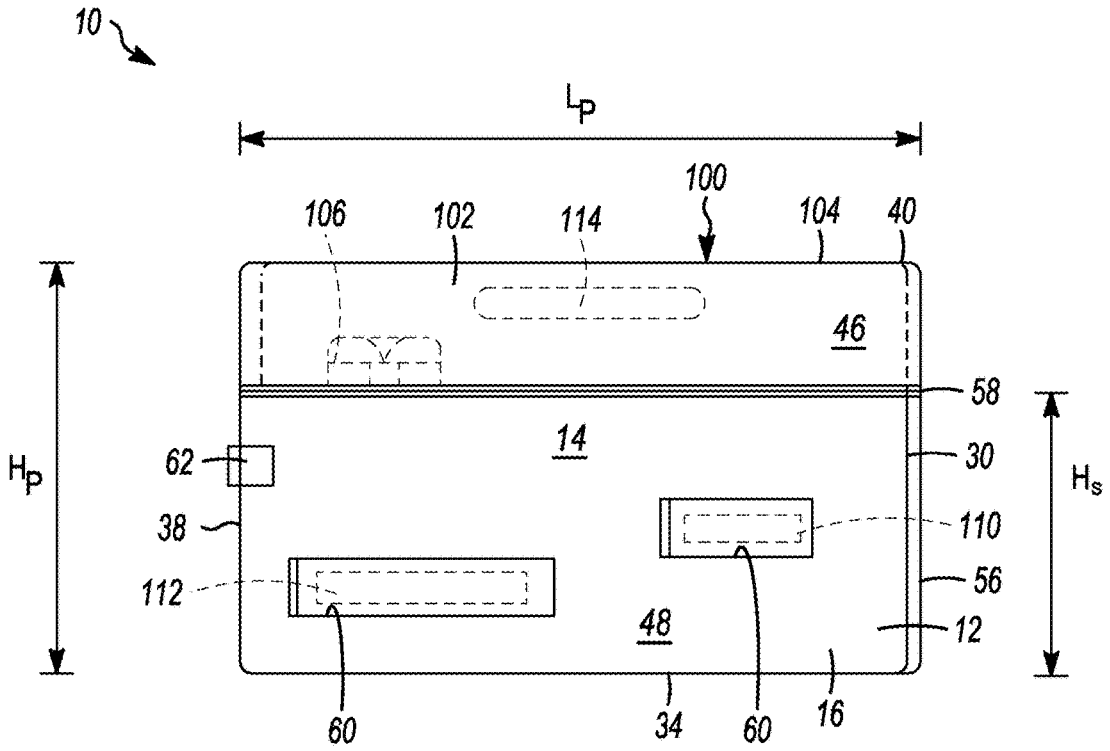
FIG. 1 is a front perspective view of an embodiment of a protective payment card sleeve as disclosed herein with a generic payment card shown in phantom in a stowed position therein.
Figure 2:
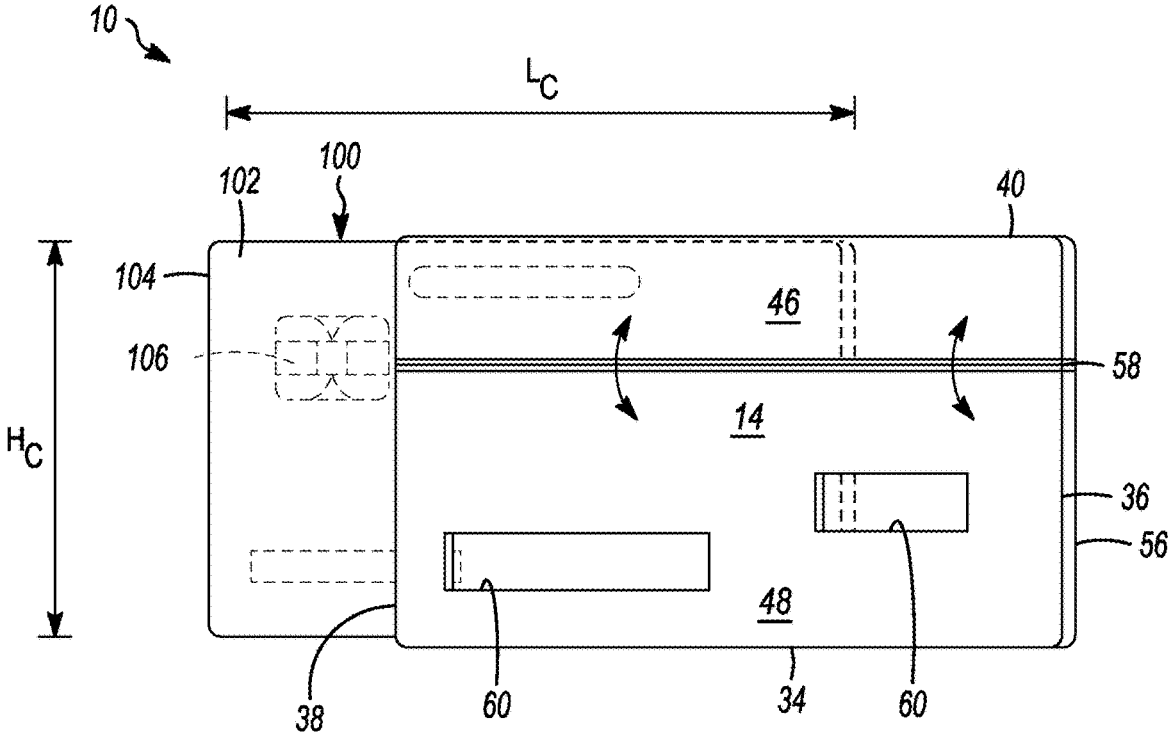
FIG. 2 is a front perspective view of an embodiment of a protective information-bearing card sleeve as disclosed herein with a generic information-bearing card depicted in phantom in partially extended position relative to the sleeve.
Figure 3:
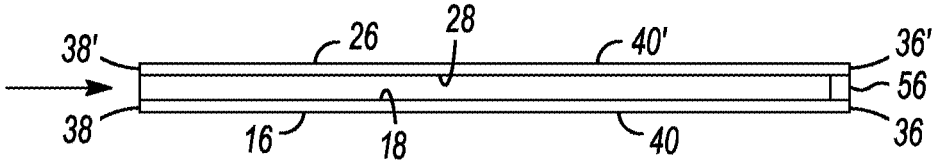
FIG. 3 is a top plan view of the protective payment card sleeve of FIG. 1.
Figure 5:
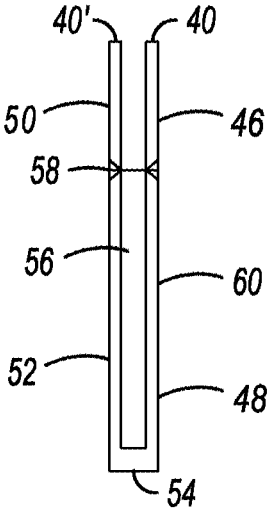
FIG. 5 is a left side view of the protective information-bearing card sleeve of FIG. 1.

In the sleeve 10 as illustrated in FIGS. 1, 2 and 5, the sleeve 10 includes a wall member 56 located on a single side of the sleeve 10 with the opposed or second side edges 38, 38' of the first planar member 12 and the second planar member 22 respectively, defining a side slot-like opening that can accommodate the portable information-bearing card 100 in sliding relationship thereto.

The sleeve 10 also includes an upper slot-like opening defined by the upper edge 40 of first panel member 12 and the upper edge 40' of second panel member 22. In certain embodiments, the upper slot-like opening so defined may have a length sufficient to accommodate the portable information-bearing card 100 when in position in the sleeve 10. In certain embodiments, the sleeve 10 can be configured such that the side slot-like opening and the upper slot-like opening are connected to form a continuous slot-like opening. In such embodiments, where the upper and side slot-like openings are continuous, it is contemplated that the associated portable information-bearing card 100 may protrude from the top and/or side of the sleeve 10. The degree of protrusion will be an amount less than would expose visible indicia 114, magnetic media 108, data chip(s) 106, etc. to unauthorized access or hacking by a third party.

In certain embodiments, at least one of the first panel member 12 or the second panel member 22 will have a height $H_P$ and a length $L_P$ that is sufficient to cover any magnetic swipe strip 108 and/or data chip 106 as well as identifying indicia 110, 112 present on the portable information-bearing card 100. The amount of coverage is that sufficient to prevent third-party access of the card-carrier's personal information by methods including, but not limited to, unauthorized electronic access, visual access and the like in a manner that facilitates unauthorized collection of such personal information. Thus, the height $H_P$ and/or the length $L_P$ may accomplish complete or partial coverage as desired or required.

In certain embodiments, it is contemplated that the first panel member 12 and the second panel member 22 can have the same height $H_P$ and/or the length $L_P$. It is also within the purview of this disclosure that the first panel member 12 can have a height $H_P$ and/or a length $L_P$ that differs from the height $H_P$ and/or the length $L_P$ of the second panel member 22.

Figure 4:
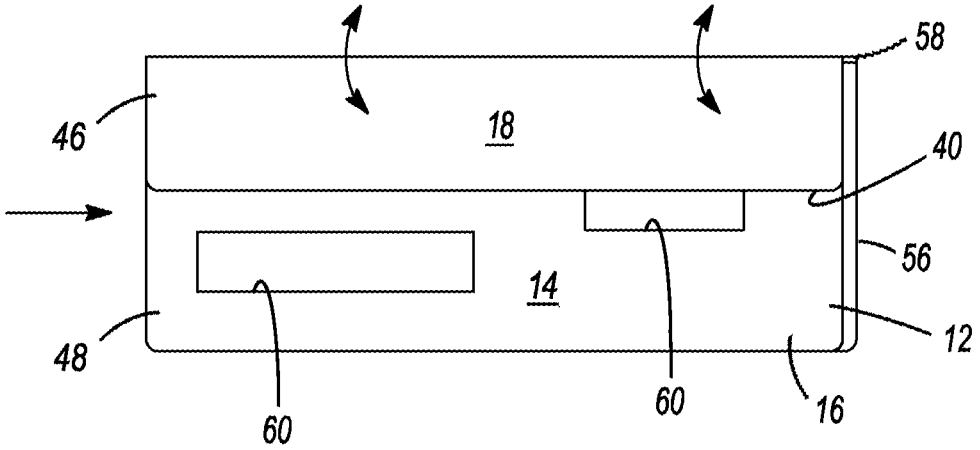
FIG. 4 is a front elevational view of the protective information-bearing card sleeve of FIG. 1.

In certain embodiments, the upper planar wall member region 46, 50 of at least one of the first planar wall member 12 and the second planar wall member 22 is movable relative to the respective lower planar wall member region 48, 52. In such embodiments, the at least one upper planar wall member region 46, 50 is moveable from a first orientation that is generally coplanar with the associated lower planar wall member region 48, 52 to at least one orientation in which the upper edge of the upper planar wall member region 46, 50 is oriented outward from the body of the sleeve 10. When in the outward orientation, the upper planar wall member region 46, 50 can have curved configuration. It is also contemplated that the upper planar wall member region 46, 50 can be angularly oriented relative to the associated lower planar wall member region 48, 52.

Where desired or required, the first planar wall member 12 and/or the second planar wall member 22 can include at least one detent 58 defined on the respective outwardly oriented face. The at least one detent 58 can be located in the junction between the respective upper planar wall member region 46, 50 and associated lower planar wall member region 48, 52 and can facilitate partial or complete folding of the upper planar wall member region 46, 50 relative to the lower region as depicted in FIG. 4.

The sleeve 10 or portions thereof can be composed of a material that renders the sleeve 10 or at least one portion such as a respective planar wall member 12, 22 visually opaque, transmissively opaque or both and is in overlying relationship with the at least one data storage media member when the portable information-bearing card 100 is releasably contained in the sleeve 10. Non-limiting examples of suitable opaque materials may include metallic foils, particulates and the like. Where desired or required, the sleeve 10 can be composed in whole or in part of a material having suitable flexibility to accommodate outward bending or movement of at least one of the upper planar wall member regions 46, 50. Suitable materials may also provide a suitable frictional contact between the portable information-bearing card 100 and the associated surfaces of the sleeve 10 to maintain the portable information-bearing card 100 in the inserted position during storage and the like.

When in use, the user wishes to grant access to the information contained in the a portable information-bearing card 100, such access to the desired data storage media can be accomplished while maintaining user data privacy. For example, if the user wishes to proceed with a transaction that involves the use of a chip reader, the portable information-bearing card 100 can be urged partially out of the sleeve 10 to a position which permits engagement between the chip 106 and the chip reader while the majority of any magnetic strip 108 as well as visual information such as account number 110, name 112, etc. is obscured from view or access by third parties by means of the sleeve 10. Once the chip 106 has been read, the portable information-bearing card reader 100 can be replaced in the sleeve 10 and the sleeve 10 returned to the wallet, purse, etc. of the user.

When the user desires to conduct a transaction using the magnetic swipe strip 108, the user can hold the sleeve 10 at the region defined by the lower planar wall regions 48, 52 with the magnetic swipe strip oriented so the upper planar wall region(s) 46, 50 overlies the swipe strip 108. Insertion of the assembly of sleeve 10 and portable information-bearing card 100 into the swipe strip card reader causes one or both of the upper planar wall regions 46, 50 to deflect or bend as along detent 58 allowing the magnetic media to be read while all other information is maintained in privacy.

The sleeve 10 as disclosed herein can also be configured in any suitable manner that will enable the card owner to identify and select the desired portable information-bearing card 100 for use. Non-limiting examples of such identity aides include color coding, external writing surfaces and the like. It is also contemplated that the sleeve 10 can be configured with one or more apertures 60 that can correspond to the location user name 112 or a portion thereof on the associated portable information-bearing card 100 and/or a portion of the account number 110 such as the last 4 digits or the like to assist in selection of the desired portable information-bearing card 100 among the number of cards carried by the user.

The sleeve 10 as disclosed herein can also include one or more anti-tamper devices to prevent or detect when the card 100 has accessed without authorization. One such anti-tamper device is a breakable or tamper evident seal 62 adapted to be positioned on the elongated side slot defined in the sleeve 10. Once the portable information-bearing card 100 is positioned in the sleeve 10, the user can attach the breakable seal 62. In situations where the user must hand over the card to complete a transaction, as can occur at various dining establishments, the user can request the transaction be completed by swipe strip only. Breakage or tampering of the seal would be apparent to the user upon return of the portable information-bearing card 100 and sleeve 10 assembly. This could permit the user to make further investigations immediately upon return of the card 100 and take measures to ensure that the user's identity or information is not compromised.

While the invention has been described in connection with what is presently considered to be the most practical embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A sleeve configured to hold a portable information-bearing card that includes a magnetic strip, an RFID chip, and/or a data chip and that has standard credit card layout and dimensions including a length, height, and thickness, wherein the sleeve comprises:

first and second planar walls each having an upper wall region and a lower wall region, the first and second planar walls being disposed in spaced parallel relationship to each other, wherein each planar wall has a peripheral edge defined by first and second side edges, an upper edge, and a bottom edge, wherein:

the planar walls are visibly and transmissively opaque, whereby in use with the card in the sleeve, the planar walls can prevent visible or transmissive access to the data stored on the card;

each edge of the peripheral edges of the planar walls is rectilinear;

each bottom edge is located at a lower end of each lower wall region;

each upper edge is located at an upper end of each upper wall region;

each side edge of each planar wall extends alongside both the upper and lower wall regions of that planar wall between the upper and lower edges of that planar wall;

the bottom edge of each planar wall is connected to the bottom edge of the other planar wall, thereby forming a bottom wall;

the lower wall region of each planar wall is connected to the lower wall region of the other planar wall along the first side edges of the planar walls, thereby forming a side wall; and the planar walls being sized relative to the dimensions of the card, such that the planar walls, bottom wall, and side wall together form a housing that can removably retain the card inside the housing and that is accessible for insertion or removal of the card from either an upper edge opening or a second side edge opening;

wherein:

each upper wall region is separated from the lower wall region by at least one detent extending between the first and second edges in a direction parallel to the bottom wall, whereby that upper wall region can flexibly bend out of plane with the lower wall region; and the at least one detent is located at a height from the bottom wall that is less than a height of the magnetic strip from the bottom of the card, whereby in use with the card in the sleeve in contact with the bottom wall, the magnetic strip can be covered by one of the upper wall regions when that upper wall region is not deflected out of plane with the lower wall region, and can be uncovered for swiping in a card reader by bending the upper wall away from the card to thereby enable use of the magnetic strip for a transaction without removing the card from the sleeve; and wherein:

the second side edge of each planar wall is adjacent to the second side edge of the other planar wall without being connected to each other so as to provide the side edge opening, the lower wall region of at least one of the first and second planar walls includes one or more apertures defined therethrough that correspond to the location of a user name and/or a portion of the account number; and the portable information-bearing card can be urged partially out of the sleeve to a position which permits engagement between the chip and the chip reader while visual information is obscured from view by the planar walls.

2. The sleeve defined in claim 1, further comprising a bottom wall member that connects the bottom edges of the planar walls together and that extends perpendicular to the planar walls, whereby the bottom wall is formed by the bottom wall member and the bottom edges of the planar walls.

3. The sleeve defined in claim 1, further comprising a side wall member that connects the first side edges of the lower wall regions of the planar walls together and that extends perpendicular to the planar walls, whereby the side wall is formed by the side wall member and the first side edges of the planar walls.

4. The sleeve defined in claim 1, wherein the lower wall region of at least one of the first and second planar members includes an aperture that aligns with card information visible on the card when in use with the card in the sleeve.

5. The sleeve as defined in claim 4, wherein the aperture is positioned in the lower wall region at a location corresponding to a location of a person's name on the card when in use with the card in the sleeve.

6. The sleeve as defined in claim 4, wherein the aperture is positioned in the lower wall region at a location corresponding to a location of four digits of a card number on the card when in use with the card in the sleeve.

7. The sleeve as defined in claim 1, wherein the side edge opening together with the bendable upper regions enables a user to flex the upper regions outward, grasp the card along its top edge, and partially slide the card out through the side edge opening for use of the data chip in a transaction while maintaining the visible and transmissive opaque protection of portions of the card that remain in the sleeve.

8. A sleeve configured to hold a portable information-bearing card, the sleeve comprising:

a first planar wall member having a first planar wall member central body region defining an outwardly oriented face and an inwardly oriented face, the inwardly oriented face opposed to the outwardly oriented face, the first planar wall member further having a first planar wall member peripheral edge, the first planar wall member peripheral edge of the first planar wall member having an upper edge and a lower opposed edge, a first side edge and a second side edge opposed to the first side edge;

a second planar wall member, the second planar wall member disposed in spaced relationship with the first planar wall member, the second planar wall member having a second planar wall member central body region defining an outwardly oriented face and an inwardly oriented face, the second planar wall member further having a second planar wall member peripheral edge, the second planar wall member peripheral edge of the second planar wall member having an upper edge and a lower opposed edge, a first side edge and a second side edge opposed to the first side edge;

a bottom edge wall member; and a side edge wall member connected to the bottom edge wall member, the side edge wall member extending to an upper edge opposed to the bottom edge wall member, wherein the first planar wall member and the second planar wall member are rectilinear and each have a lower planar wall region connected to the side edge wall member and the bottom edge wall member and each have an upper planar wall region extending from their respective lower wall planar region, wherein the bottom edge wall member is connected at the lower opposed edge of the first planar wall member peripheral edge and the lower opposed edge of the second planar wall member peripheral edge such that the bottom edge wall member extends between the lower opposed edge of the first planar wall member peripheral edge and the lower opposed edge of the second planar wall member peripheral edge, wherein the first planar wall member and the second planar wall member are connected to the side edge wall member at one of the respective first or second side edge of the first planar wall member peripheral edge and at one of the respective first or second side edge of the second planar wall member peripheral edge, wherein the first planar wall member and the second planar wall member have a height ($H_p$) and the side edge wall member has a height ($H_s$), wherein ($H_s$) is less than ($H_p$), wherein the first planar wall member, the second planar wall member, the bottom edge wall member and the side edge wall member define an information bearing card receiving chamber accessible from a side edge opening and an upper edge opening, wherein the respective upper planar wall member regions are flexibly moveable relative to the associated lower planar wall member regions and to each other, wherein the at least one of the first planar wall member or second planar wall member is composed of a material that renders the respective planar wall member visually opaque and transmissively opaque and the respective planar wall member is in overlying relationship with the at least one data storage media member when a portable information-bearing card is releasably contained in the sleeve, wherein at least one of the first planar wall member or the second planar wall member has at least one aperture defined in the central body thereof, the at least one aperture positioned to overly at least one indicia present on the portable information-bearing card, and wherein the upper planar wall region of the first planar wall member and the upper planar wall region of second planar wall member are deflectable away from the portable information-bearing card while said card is releasably contained in the sleeve.

9. The sleeve as defined in claim 8, wherein at least one of the first planar wall member and the second planar wall members has a detent defined in the outwardly oriented face of the associated central body region at a location between the upper edge and the lower opposed edge of the associated central body region at a location opposed to the central body region of the other planar wall member and wherein the respective central body regions of the first planar wall member and the second planar wall member are rectilinear, wherein the respective detents extend from the first side edge to the second side edge of the associated central body at a location coplanar with the upper edge of the side wall member.

10. The sleeve as defined in claim 9, wherein the at least one detent present in the at least one central body region defines an upper planar wall member region and a lower planar wall member region in the associated central body region, the upper planar wall member region flexibly moveable relative to the lower planar wall member region between an orientation coplanar to the lower planar wall member region and an orientation projecting angularly outward from the lower planar wall member.

11. The sleeve as defined in claim 8, wherein the sleeve defines a slot-like opening between the respective second side edges of the first planar wall member and the second planar wall member and an upper opening defined by the first planar wall member and the second planar wall member.

12. The sleeve as defined in claim 8, wherein at least one data storage media member is at least one of an RFID chip, data microchip, magnetic storage media swipe strip.

13. The sleeve as defined in claim 8, wherein at least one of the first planar wall member and the second planar wall member is composed of a flexible polymeric material and is configured to frictionally contact a portable information-bearing card releasably contained in the sleeve.

14. A sleeve configured to hold a portable information-bearing card, the sleeve comprising:

an opaque first planar wall member having a first planar wall member central body region defining an outwardly oriented face and an inwardly oriented face, the inwardly oriented face opposed to the outwardly oriented face, the opaque first planar wall member further having a first planar wall member peripheral edge, the first planar wall member peripheral edge including an upper edge and an opposed lower edge, a first side edge and an opposed second side edge, a bottom edge and a top edge opposed to the bottom edge, wherein the opaque first planar wall member has an upper planar wall member region proximate to the upper edge of the peripheral edge and a lower planar wall member region proximate to the lower edge of the peripheral edge;

an opaque second planar wall member, the second planar wall member disposed in spaced relationship with the opaque first planar wall member, the opaque second planar wall member having a second planar wall member central body region defining an outwardly oriented face and an inwardly oriented face, the opaque second planar wall member further having a second planar wall member peripheral edge, the peripheral edge including an upper edge and an opposed lower edge, a first side edge and an opposed second side edge, wherein the opaque second planar wall member has an upper planar wall member region proximate to the upper peripheral edge and a lower planar wall member region proximate to the lower peripheral edge;

a bottom edge wall, the bottom edge wall connected to the first wall member peripheral edge and the second wall member peripheral edge at a location proximate to the respective lower regions and extending there between such that the lower region of the first wall member is in spaced parallel relationship to the lower region of the second wall member and defining a slot there between configured to releasably receive a portable information-bearing card therein; wherein the upper planar wall member region of at least one of the first planar wall member and second planar wall member is flexibly moveable relative to the associated lower planar wall member region between an orientation coplanar to the lower planar wall member region and an orientation projecting angularly outward from the lower planar wall member and wherein the upper edge of the first planar wall member and the upper edge of the second planar wall member are coplanar; and a side edge wall having a side wall height ($H_s$), the side edge wall connected to the first planar wall member peripheral edge and the second planar wall member peripheral edge at a location proximate to the lower edge wall and extending upward therefrom to a terminus between the upper edge and lower edge of the respective first planar wall member and second planar wall member; and a portable information-bearing card releasably contained between the first planar wall member and the second planar wall member, the portable information bearing card having a portable information-bearing card height ($H_c$) that is greater that side wall height ($H_s$), wherein the sleeve has a side slot defined between the opaque first panel member and the opaque second panel member at a location opposed to the side edge wall thought which the portable information card can laterally translate, wherein the portable information-bearing card releasably contained in the sleeve is composed of a planar member heaving a first card face and a second card face, the first card face opposed to the second card face, the portable information-bearing card having at least one data storage media member located on at least one of the first card face or the second card face, wherein the at least one of the first planar wall member or second planar wall member are composed of a material that renders the respective wall member visually opaque and transmissively opaque and is in overlying relationship with the at least one data storage media member when the portable information bearing card is releasably contained in the sleeve, and wherein at least one of the first planar wall member or the second planar wall member has at least one aperture defined in the central body region thereof, the at least one aperture positioned to overly at least one indicia present on the portable information-bearing card.

* * * * *